US005118412A

United States Patent [19]

Schmidt

[11] Patent Number: 5,118,412

[45] Date of Patent: Jun. 2, 1992

[54] FLUID RECOVERY APPARATUS

[76] Inventor: Richard J. Schmidt, 4426 Kitty La., Batavia, Ohio 45103

[21] Appl. No.: 686,670

[22] Filed: Apr. 17, 1991

[51] Int. Cl.[5] ..... E02B 15/04

[52] U.S. Cl. ..... 210/122; 210/242.3; 210/923

[58] Field of Search ..... 210/122, 242.3, 540, 210/923

[56] References Cited

U.S. PATENT DOCUMENTS

| | | | |
|---|---|---|---|
| 1,450,545 | 4/1923 | Hans | 210/122 |
| 2,497,177 | 2/1950 | McClintock | 210/242.3 |
| 3,223,243 | 12/1965 | Muller | 210/242.3 |
| 3,495,561 | 2/1970 | Trapp | 210/242.3 |
| 3,523,611 | 8/1970 | Fitzgerald | 210/242.3 |
| 3,529,720 | 9/1970 | Chablaix | 210/242.3 |
| 3,534,859 | 10/1970 | Amero | 210/242.3 |
| 3,690,463 | 9/1972 | O'Brien | 210/22.3 |
| 3,693,800 | 9/1972 | Stanfield et al. | 210/242.3 |
| 3,722,688 | 3/1973 | Wirshing | 210/242.3 |
| 3,722,690 | 3/1973 | Stenström | 210/242.3 |
| 3,831,756 | 8/1974 | Bhuta et al. | 210/242.3 |
| 4,132,645 | 1/1979 | Bottomley | 210/540 |
| 4,610,635 | 9/1986 | Austevoll | 405/60 |
| 4,610,788 | 9/1986 | Ward | 210/242.3 |
| 4,623,459 | 11/1986 | Benaroya | 210/242.3 |
| 4,626,358 | 12/1986 | Fetsko | 210/242.3 |
| 4,642,185 | 2/1987 | Turner | 210/242.3 |
| 4,653,421 | 3/1987 | Ayers | 210/242.3 |
| 4,673,397 | 6/1987 | Lundin | 210/242.3 |
| 4,681,680 | 7/1987 | Delons | 210/242.3 |
| 4,690,093 | 9/1987 | Lundin | 210/242.3 |
| 4,734,193 | 3/1988 | Cvitas et al. | 210/242.3 |
| 4,741,827 | 5/1988 | Klinar | 210/242.3 |
| 4,752,393 | 6/1988 | Meyers | 210/242.3 |
| 4,797,210 | 1/1989 | Lonardo | 210/242.3 |
| 4,842,735 | 6/1989 | Hollis et al. | 20/242.3 |

FOREIGN PATENT DOCUMENTS

| | | |
|---|---|---|
| 402609 | 4/1974 | U.S.S.R. . |
| 804368 | 11/1958 | United Kingdom . |
| 2006037 | 5/1979 | United Kingdom . |

*Primary Examiner*—Stanley S. Silverman
*Assistant Examiner*—Christopher Upton
*Attorney, Agent, or Firm*—Frost & Jacobs

[57] ABSTRACT

A device for removing a fluid layer off of another fluid surface is shown. The device includes a funnel having a converging surface and a flow exit area. The device further includes an upper member having a corresponding converging surface which is adjacent to the converging surface of the funnel, and defining a converging annular passageway extending generally from the periphery of the funnel to the flow exit area of the funnel.

19 Claims, 4 Drawing Sheets

FLUID RECOVERY APPARATUS

TECHNICAL FIELD The present invention relates generally to the art of fluid recovery and the removal of a liquid which is floating on top of another liquid. In particular, the present invention is directed to an apparatus for suctioning a liquid such as oil off of a water surface.

BACKGROUND OF THE INVENTION

In a variety of fields, a need often arises to physically separate two liquids. This separation is facilitated when the liquids have different densities. When a mixture is comprised of two liquids of different densities, the force of gravity encourages the higher density fluid to settle near the bottom of the mixture while the lower density fluid generally rests on top of the higher density fluid. As such, the two liquids often separate into two substantially distinct layers. An example of such a process occurs when a liquid hydrocarbon such as oil is mixed with water.

Since liquid oil generally has a lower density than liquid water, when the two are mixed or otherwise come into contact, the liquid oil generally rises within the mixture as the higher density water settles towards the bottom of the oil-water mixture. When a steady state environment has been established, the liquid oil generally forms a layer resting on top of the water.

In the environment, the presence of oil in water, particularly on the surface of a body of water, can have a devastating impact on the environment. As experience has shown, the oil can easily kill both fish and other aquatic animals, upsetting the delicate ecological balance of nature. In addition to constituting a fire hazard, the oil makes the water unfit for human consumption. Unrecovered, the economic loss of the oil may be substantial.

Depending on the particular hydrocarbon involved, little time is generally available for removing the oil from the water surface before the oil sinks to the ecological environment below the water surface, or pollutes nearby land. Heretofore, there has not existed a simple yet efficient means for collecting the oil during the relatively short period of time before ecological damage occurs. In addition, there has not existed a simple yet efficient fluid recovery device which can recover a fluid which is on fire.

Moreover, there has not been available such an efficient oil collecting device which could function in a variety of turbulent water environments. In such turbulent environments, wind and waves would often disrupt and displace previously known oil skimmers, thereby reducing the amount of oil collected and increasing the time required to collect the oil.

The prior art devices which have attempted to remove oil off of the surface of water have been generally inefficient and difficult to manufacture and operate. For example, U.S. Pat. No. 3,534,859 discloses a device 10 for removing oil floating on water. Device 10 is shown comprising an inner flotation member 12, an outer stabilizing and buoyancy member 14, and a plurality at rib members 16 interconnecting members 12 and 14. As can be seen in FIG. 2 of U.S. Pat. No. 3,534,859, oil layer 26 flows, as a result of gravity, into the interior of device 10 for collection through hose 44.

However, this device has a number of disadvantages. The collection of oil layer 26 is limited by the gravity flow rate of the oil into the apparatus. In addition, the height of inner flotation member 12 is regulated by adjusting the volume of air and water within flotation member 12, a burdensome and often inaccurate method. Furthermore, the use of ring-shaped outer stabilizing member 14 and ring-shaped inner flotation member 12 allows for water and debris to enter tube 44 and reduce the efficiency of the apparatus. For these and other numerous reasons, device 10 often does not meet the critical needs associated with oil recovery.

Consequently, heretofore, there has not been available in the industry a convenient, simple, and efficient device for suctioning a fluid located on top of another fluid. In particular, such a device has not existed for suctioning oil off of a water surface. Because of the massive amounts of oil that sometimes are deposited on water surfaces, there has not been available heretofore a simple device for quickly removing the oil before significant ecological damage has occurred. Moreover, heretofore there has not been available an oil suctioning apparatus which can be easily adjusted to compensate for different oil layer thicknesses.

DISCLOSURE OF THE INVENTION

It is an object of this invention to provide a device for removing a liquid located on top of another liquid.

It is another object of the present invention to provide a device for removing the top layer of a liquid in an efficient and convenient manner.

It is a further object of the present invention to provide a device for removing an oil layer off of a water surface.

It is yet another object of the present invention to provide a device for removing an oil layer off of a water surface, which can be adjusted to compensate for different oil layer thicknesses.

It is also an object of this invention to provide an oil suctioning apparatus that can operate in, and is relatively stable during, rough water conditions.

It is a further object of the present invention to provide a device for recovering a fluid which is on fire.

In accordance with one aspect of the present invention, there is provided a device for removing a fluid layer off of another fluid surface. The device includes a funnel having a converging surface and a flow exit area. The device further includes an upper member having a corresponding converging surface which is adjacent to the converging surface of the funnel, and defining a converging annular passageway extending generally from the periphery of the funnel to the flow exit area of the funnel.

In accordance with another aspect of the present invention, a buoyancy means is provided with the device.

In accordance with a further aspect of the present invention, one or more adjustment means are provided for regulating the size of the converging annular passageway.

In one aspect of the present invention, a nut is fixed to the funnel. A bolt is provided through the nut and funnel, extending through an annular passageway and into the upper member, where it is attached to a rotatable sprocket and is prevented from longitudinal movement by a sleeve. When the sprocket is rotated, the bolt is likewise rotated, causing axial displacement of the funnel and a change in the relative positions of the funnel and upper member and, therefore, the width of the passageway therebetween.

In another aspect of the present invention, the adjustment means for controlling the size of the annular passageway comprises an upper shaft attached to the upper member, and a lower shaft attached to the funnel. The upper shaft and lower shaft may be selectively rigidly attached to each other by means of a pin to maintain the relative positions of the funnel and upper member at a predetermined distance corresponding to the desired passageway width.

Still other objects of the present invention will become apparent to those skilled in this art from the following description wherein there is shown and described a preferred embodiment of this invention, simply by way of illustration, of the best mode presently contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

While the specification concludes with claims particularly pointing and distinctly claiming the present invention, it is believed the same will be better understood from the following description taken in conjunction with the accompanying drawings in which:

DETAILED DESCRIPTION OF THE INVENTION

Figure 1:
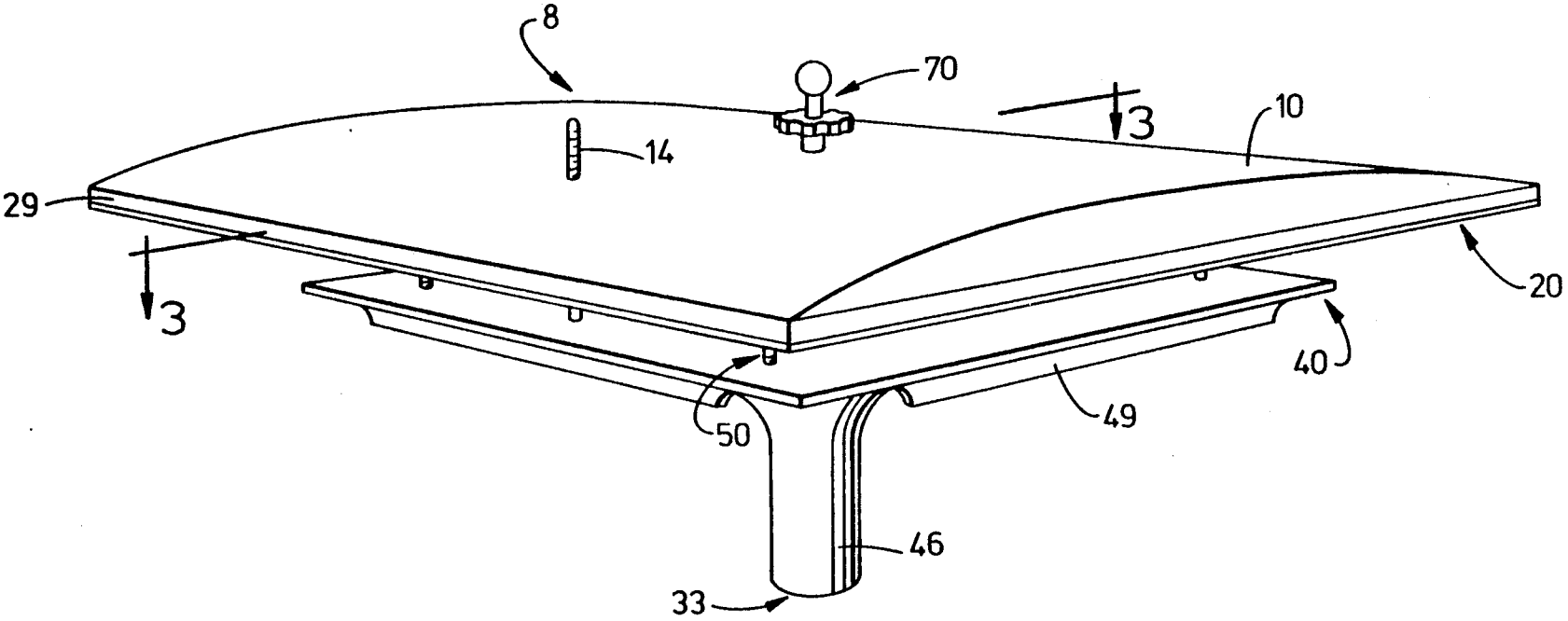
FIG. 1 is a perspective view of a preferred embodiment of a suctioning apparatus made in accordance with the subject invention.

Referring now to the drawings in detail, wherein like numerals indicate the same elements throughout the views, FIG. 1 illustrates a perspective view of a preferred embodiment of suctioning apparatus 8 made in accordance with the subject invention.

Figure 2:
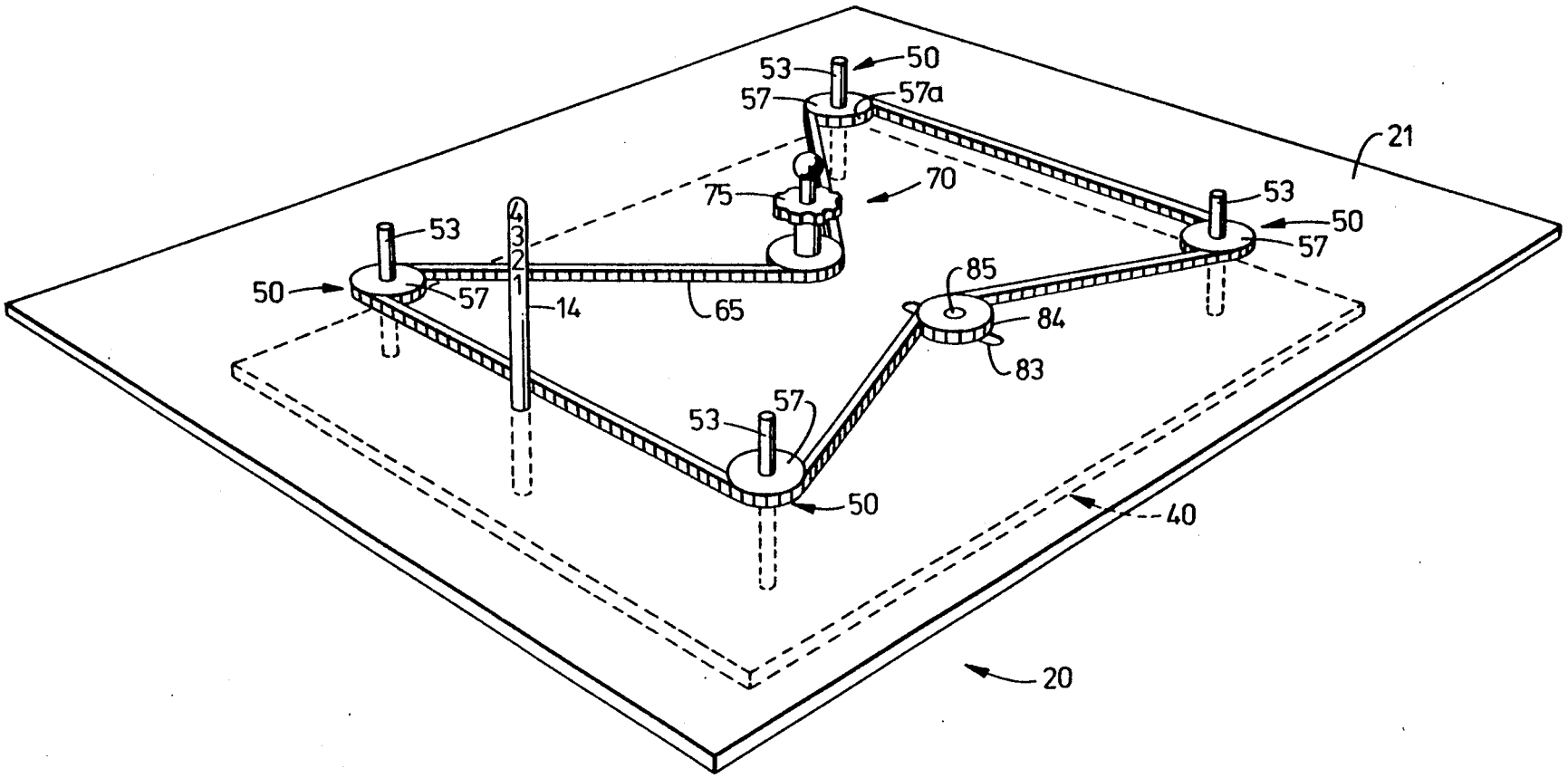
FIG. 2 is a partial perspective view of the suctioning apparatus of FIG. 1, showing the linkage of the control assembly and adjustment assembly in more detail.
Figure 3:
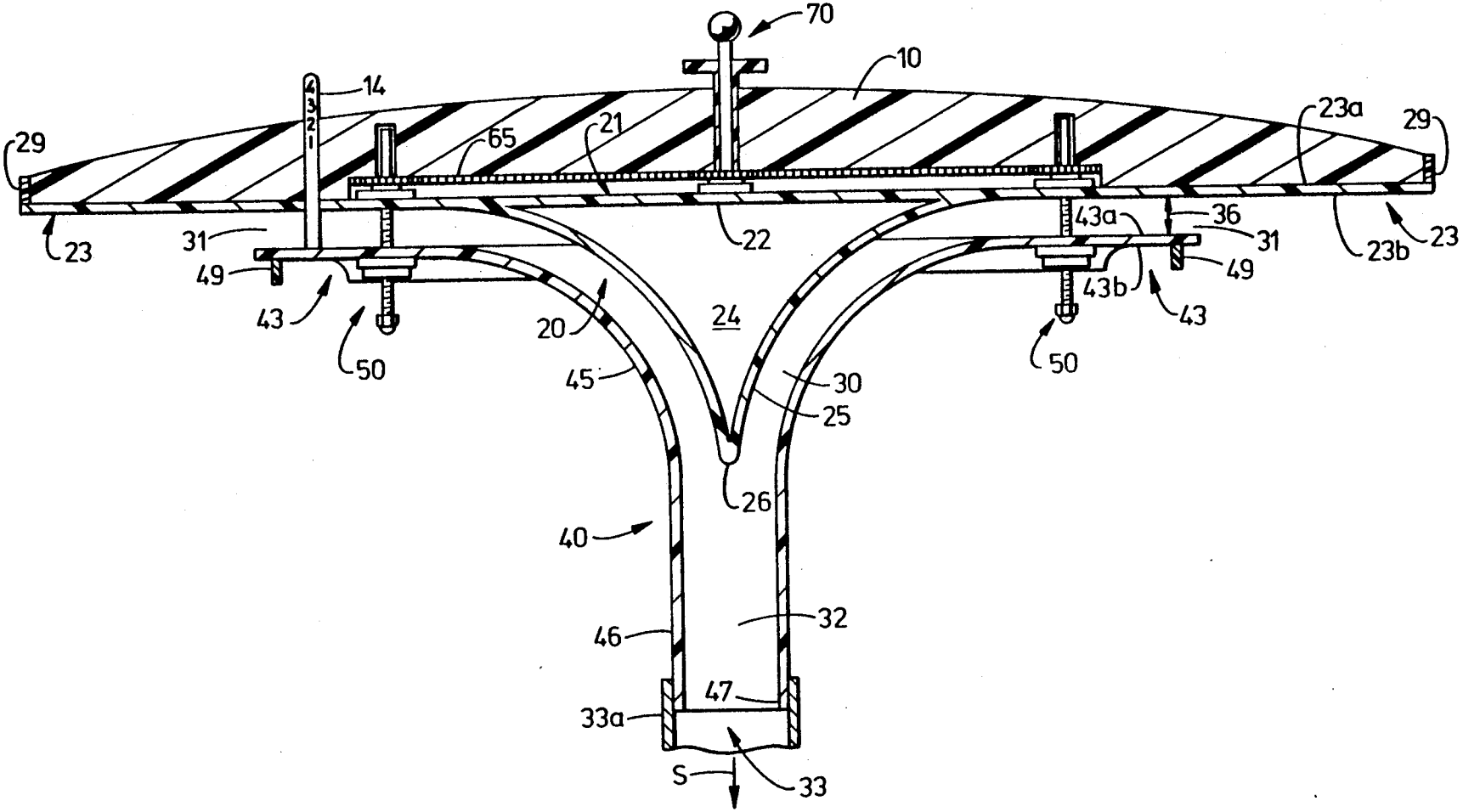
FIG. 3 is a cross-sectional elevational view of the suctioning apparatus shown in FIG. 1 taken along section lines 3—3, with portions of the cover removed to more clearly disclose the control assembly and adjustment assembly of the subject invention.

Suctioning apparatus 8 is shown in FIGS. 1-3 as preferably comprising upper member 20, funnel 40, adjustment assembly 50, and control assembly 70.

As can be best seen in FIG. 3, upper member 20 preferably comprises an upper member plate 21 and a conical portion 25 which is disposed beneath the central portion of upper member plate 21. Upper member plate 21 generally comprises an upper member peripheral area 23 and an interior portion 22. Interior portion 22 is generally defined as the interior area of upper member plate 21 and generally corresponds to the area of upper member plate 21 above conical portion 25. Upper member peripheral area 23 is generally defined as the portion of upper member plate 21 extending outwardly beyond conical portion 25. In general, as shown in FIG. 2, upper member plate 21 comprises a rectangular planar surface. However, other configurations may be utilized. By way only of example, upper member plate 21 may be circular in shape.

As shown in FIG. 3, conical portion 25 is preferably attached to the central portion of upper member plate 21, defining a space 24 in upper member 20 between upper member plate 21 and conical portion 25. As will be later understood, it is preferred that space 24 contain a vacuum, air, or any substance having a density less than water, so as to resist submersion of upper member plate 21 in a liquid such as water or oil, i.e., so that plate 21 will float in or above the oil layer.

Conical portion 25 preferably has a converging configuration, terminating at lower end 26. As shown in FIG. 3, conical portion 25 has an inverted cone-like configuration. However, other configurations are possible. For example, conical portion 25 may utilize either a straight or curved line rotated in space to form a converging surface. As previously discussed, conical portion 25 is preferably attached to the central portion of upper member plate 21. Conical portion 25 may be formed integrally with upper member plate 21, or may be attached by any suitable means such as glue, welding, or other secure attachment means. Where conical portion 25 is formed integrally with upper member plate 21, or separately attached thereto, upper member plate 21 preferably comprises a one-piece structure comprising interior portion 22 and upper member peripheral area 23.

In an alternative arrangement, conical portion 25 may be integrally formed with upper member peripheral area 23. In such an arrangement, interior portion 22 would be preferably attached above conical portion 25 to form space 24. Interior portion 22 would be attached to either conical portion 25 or upper member peripheral area 23 by any secure means, such as glue, welds, or other secure attachments. In the various arrangements, it is preferred that interior portion 22 and upper member peripheral area 23 constitute a planar upper member plate 21.

It is preferred that upper member 20 comprise plastic, although any other material may be used such as ceramics or metals. However, it is preferred that upper member 20 comprise a material having low density and high strength characteristics so as to limit any submersion of upper member plate 21 in a liquid, as will be discussed herein.

Disposed generally below upper member 20 is funnel 40. Funnel 40 preferably comprises funnel peripheral area 43 and conical portion 45. Funnel peripheral area 43 preferably has a rectangular and planar configuration, comprising the portion of funnel 40 adjacent upper member peripheral area 23. Conical portion 45 extends generally inwardly from funnel peripheral area 43. It is preferred that conical portion 45 of funnel 40 have a configuration corresponding to that of conical portion 25 of upper member 20. In the preferred embodiment, conical portion 45 of funnel 40 has an invented cone-like converging configuration. However, any other funnel-like converging configuration may be utilized.

Conical portion 45 of funnel 40 preferably terminates at the lower extreme at exit portion 46. Exit portion 46 of funnel 40 is preferably cylindrical in shape, and defines a flow convergence area 32 which terminates at opening 47. Exit portion 46 may be of any configuration so as to provide a convenient area in which to collect a liquid passing through funnel 40. Funnel 40 may comprise any suitable material such as plastic, ceramic, or metal. However it is preferred that a low density and high strength material such as plastic be utilized for reasons which will be discussed herein.

As best shown in FIG. 3, upper member plate 21 is preferably disposed above funnel 40 such that a portion of conical portion 25 of upper member 20 is disposed at least partially within conical portion 45 of funnel 40, thereby defining a converging annular Passageway 30 between upper member 20 and funnel 40. As can be seen, passageway 30 generally extends from funnel peripheral area 43 to lower end 26. At lower end 26 of upper member 20, passageway 30 converges into flow convergence area 32, which is defined by flow exit area 33, and which communicates with opening 47 of funnel 40.

As can be understood, when a suction force, for example through a suitable suction hose 33*a*, is provided at opening 47 in the direction of arrow S, the suction force is transmitted and maintained within flow convergence area 32 and passageway 30 to flow entrance area 31. Flow entrance area 31 is the opening provided between upper member peripheral area 23 and funnel peripheral area 43. As is readily apparent, when a suction force is provide at opening 47, only those liquids in proximity to flow entrance area 31 be drawn into passageway 30 and thereafter removed by the suction force. If too much suction force is applied, and dependent upon the actual construction of the present invention, it is possible that lower end 26 of upper member 20 may be drawn to a particular portion of conical portion 45 of funnel 40. In an alternative embodiment (not shown), ribs should be located within passageway 30 to maintain a uniform passageway 30 about the circumference of suctioning apparatus 8. Such ribs could be utilized to maintain a minimum width in passageway 30 while allowing for the selective adjustment of passageway 30.

Figure 4:
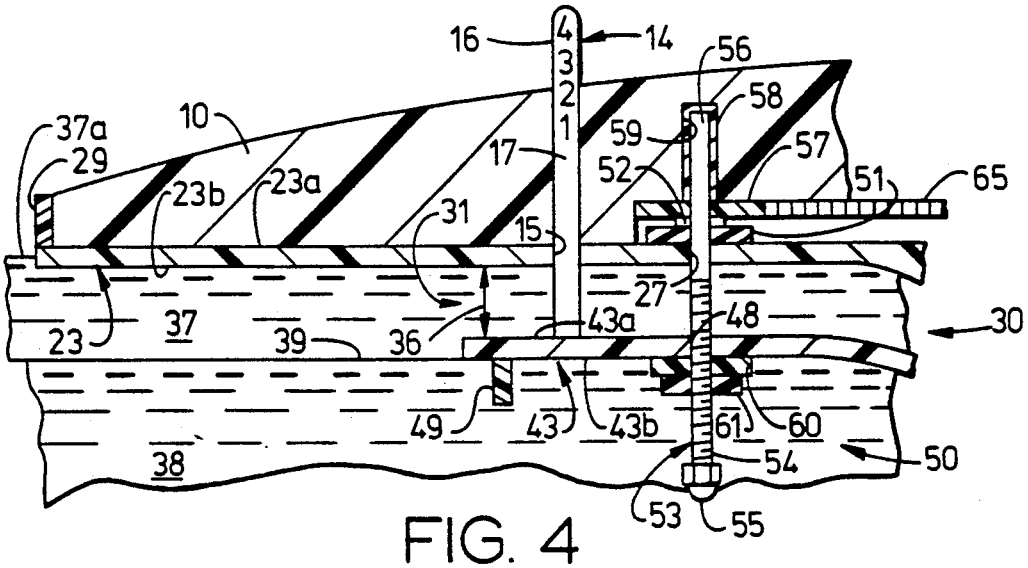
FIG. 4 is an enlarged partial cross-sectional elevational view of the left-hand portion of the adjustment assembly shown in FIG. 3 with the suctioning apparatus in an operational environment.

As best shown in FIGS. 3 and 4, in the preferred embodiment of the present invention, upper member ribs 29 are provided on upper member plate 21. Upper member ribs 29 are generally attached by any secure means, such as glue or welds, to the upper surface 23*a* of upper member peripheral area 23. Upper member ribs 29 are preferably rectangular in shape and extending along the perimeter of upper surface 23*a*. Upper member ribs 29 function to provide structural support to upper member 20 and reduce any distortions from a planar surface in upper member plate 21. Therefore, it is preferred that upper member ribs 29 be constructed so as to resist deformation from their horizontal axis.

Likewise, it is preferred that funnel ribs 49 be provided on funnel 40. Funnel ribs 49 are preferably attached to the lower surface 43*b* of funnel peripheral area 43 and extending along the perimeter of funnel peripheral area 43. Funnel ribs 49 may be attached to funnel 40 by any secure means such as glue or welds. As best seen in FIG. 4, and as will become apparent, it is preferred that upper member ribs 29 be located on the upper surface 23*a* of upper member peripheral area 23, and funnel ribs 49 located on the lower surface 43*b* of funnel peripheral area 43, so that ribs 29 and 49 do not interfere with the flow of a liquid into flow entrance area 31. Ribs 49 generally provide structural support to upper member peripheral area 43 and reduce any distortions from a planar surface in upper member peripheral area 43.

Referring now to FIG. 3, in operation, suctioning apparatus 8 is placed in the environment containing a liquid to be suctioned. A suction device (not shown) is attached to suction hose 33*a*, which in turn is connected to opening 47 of funnel 40. The reduction in pressure caused by the suction device at flow exit area 33 will cause a reduction in pressure in flow convergence area 32 and passageway 30. As a result of the decreased pressure in passageway 30 near flow entrance area 31, the liquid near flow entrance area 31 will flow into passageway 30 and to opening 47 for collection by the suction device.

As best shown in FIG. 4, where the liquid to be suctioned is contained within a discernable layer on top of another surface, such as oil layer 37 on top of water layer 38, it is desired that the lower surface 23*b* of upper member peripheral area 23 be positioned either near the top or slightly below upper surface 37*a* of the liquid (e.g. oil 37) to be suctioned. If the lower surface 23*b* of upper member peripheral area 23 is above upper surface 37*a* of oil layer 37, air could be introduced into passageway 30, decreasing the amount of oil 37 suctioned into passageway 30.

It is also preferred that the upper surface 43*a* of funnel peripheral area 43 be maintained at or slightly above the oil-water interface boundary 39 so as to suction as much oil 37 as possible while limiting the amount of water 38 also suctioned.

As best shown in FIG. 4, in the preferred embodiment, upper member peripheral area 23 extends outwardly beyond funnel peripheral area 43. In such an arrangement, since upper member peripheral area 23 is preferably located at upper oil surface 37*a*, upper member peripheral area 23 will generally reduce any turbulence at upper oil surface 37*a* near flow entrance area 31. The reduction in turbulence of surface 37*a* and oil layer 37 should allow for more efficient suctioning of oil layer 37.

In the preferred operation of the present invention, upper oil surface 37*a* is maintained at or above lower surface 23*b* of upper member peripheral area 23. Such operation generally limits the amount of any air suctioned by suctioning apparatus 8. If such outside air is sufficiently restricted, any fire (not shown) on upper oil surface 37*a* would be extinguished as the ignited oil is drawn by the suction force beneath upper member peripheral area 23 and into passageway 30. As is known, the presence of air is generally required to sustain a fire. It is believed that any air present beneath upper member peripheral area 23 or within passageway 30 would be immediately consumed by the fire, thereby extinguishing the fire before oil layer 37 exits suctioning apparatus 8.

Where suctioning apparatus 8 is intended for use with ignited hydrocarbons, it is preferred that suctioning apparatus 8 comprise materials capable of withstanding the temperatures associated with such fires.

Moreover, if the outer portion of upper member peripheral area 23 is made sufficiently large the surface tension caused by the interaction of the upper member peripheral area 23 and upper oil surface 37*a* should add to the buoyancy of upper member 20. The presence of a vacuum or air in space 24 will likewise contribute to the buoyancy of suctioning apparatus 8.

When upper member plate 21 and funnel peripheral area 43 are constructed as rectangular in configuration, it is believed that the suction force at flow entrance area 31 will be greater at those locations closest to passageway 30. These locations should correspond to the midpoint locations on the respective sides of upper member plate 21. Where upper member plate 21 and funnel peripheral area 43 are circular in configuration, it is believed that the suction force provided at flow entrance area 31 would be generally uniform about its perimeter.

In order to selectively adjust the width of gap 36 of flow entrance area 31 between upper member peripheral area 23 and funnel peripheral area 43, one or more adjustment assemblies 50 may be provided with the present invention. It can be understood that the adjustment of gap 36 of flow entrance area 31 will likewise influence the width of passageway 30.

As best seen in FIG. 2, in the preferred embodiment of the subject invention, suctioning apparatus 8 utilizes four adjustment assemblies 50. Adjustment assemblies 50 are preferably provided in a uniform pattern with suction apparatus 8. As can be seen in FIG. 3, adjustment assemblies 50 are located at funnel peripheral area 43 and upper member peripheral area 23. Although it is preferred that four adjustment assemblies 50 be utilized with the present invention to provide more uniform control of gap 36 between upper member 20 and funnel 40, other configurations are possible. By way of example only, in an alternative arrangement (not shown), three adjustment assemblies 50 could be utilized, preferably spaced equidistant from each other.

A preferred embodiment of adjustment assembly 50 is best shown in FIG. 4. Adjustment assembly 50 preferably comprises nut 61, bolt 53, and sprocket wheel 57.

Bolt 53 preferably passes through and is rotatably secured within upper member peripheral area 23 and funnel peripheral area 43 by means such as upper bolt opening 27 and lower bolt opening 48, respectively. In the preferred arrangement shown in FIG. 4, sprocket wheel 57 is fixedly secured to upper bolt portion 56 of bolt 53. Upper bolt portion 56 is that portion of bolt 53 located above upper member peripheral area 23. Sprocket wheel 57 is preferably circular in configuration, having a plurality of equally sized and spaced teeth, one of which is shown at 57*a* in FIG. 2, for engagement with chain or belt 65, as will be discussed herein. Sprocket wheel 57 may comprise any suitable material such as plastic or metal.

Sprocket wheel 57 is securely attached to and disposed about upper bolt portion 56 such that the rotation of sprocket wheel 57 will cause bolt 53 to rotate. Sprocket wheel 57 may be attached to bolt 53 by any secure means such as glue or welds.

As shown in FIG. 4, an upper support 51 and spacer 52 may be provided to assist in the stability and operation of adjustment assembly 50. In an preferred arrangement, upper support 51 is securely fixed to upper surface 23*a* of upper member peripheral area 23. Upper support 51 may be attached to upper member plate 21 by any secure means such as glue or welds. Upper support 51 provides lateral support to bolt 53 so as to generally limit transverse movement of bolt 53.

Spacer 52 is provided on upper support 51 to assist in the rotation, and reduce the wear, of sprocket wheel 57. Sprocket wheel 57 is rotatably mounted on spacer 52. Upper support 51 and spacer 52 are preferably circular in configuration and are constructed of plastic. However, any suitable configuration and low friction material may be utilized to displace sprocket wheel 57 from upper member plate 21 such that sprocket wheel 57 may freely rotate without undue wear to either sprocket wheel 57 or upper member plate 21.

As can be understood, upper bolt opening 27 provided through upper member plate 21 likewise extends through upper support 51, spacer 52, and sprocket wheel 57 such that the upper bolt portion 56 of bolt 53 may pass therethrough. Upper bolt portion 56 is generally free to rotate within the upper bolt opening 27 provided through upper member plate 21, upper support 51, and spacer 52. As previously described, sprocket wheel 57 is rigidly attached to upper bolt portion 56 by any secure means such as glue or welds, such that the rotation of sprocket wheel 57 will cause a corresponding rotation in bolt 53. Bolt 53 preferably has low density and high strength characteristics such as plastic, although metals or ceramics may be utilized.

Disposed about upper bolt portion 56 above sprocket wheel 57 is a sleeve 58. Sleeve 58 prevents the axial displacement of bolt 53 and sprocket wheel 57 in an upward direction, and is fixed within a cooperating bore or sleeve opening 59 in cover 10.

Generally dome-shaped cover 10, as best seen in FIG. 3, is shown generally disposed on the upper surface (e.g. upper surface 23*a*) of upper member plate 21. In the preferred embodiment, cover 10 comprises a material having a density less than water or oil, such as polystyrene, and is rigidly affixed to upper member plate 21. However, sufficient voids are provided in cover 10 to allow for the components of the present invention located above upper member plate 21. Cover 10 may be sprayed or treated with paint, polyvinyl chloride, or other coating to protect cover 10 from the environment. In operation, if cover 10 has a density less than oil or water, cover 10 can be utilized to prevent the complete submersion of suctioning apparatus 8 due to rough water and waves.

A lower support 60 is rigidly attached to the lower surface 43*b* of funnel peripheral area 43 by any secure means such as glue or welds. A threaded nut 61 is rigidly attached to the bottom surface of lower support 60. A lower bolt opening 48 is provided in funnel peripheral area 43, lower support 60, and nut 61, such that bolt 53 may pass rotatably therethrough, and threads 54 of bolt 53 may engage cooperating threads (not shown) of nut 61. Lower support 60 and nut 61 may comprise plastic, ceramic or metal.

As can be understood, the rotation of sprocket wheel 57 causes bolt 53 to rotate. Because of the threaded engagement of bolt 53 with nut 61, the rotation of bolt 53 creates a force which would generally cause the rotation of nut 61. However, since nut 61 is rotatably fixed to lower support 60 and funnel peripheral area 43, nut 61 is axially displaced along the threaded portion of bolt 53. A cap or acorn nut 55 is provided on the lower end of bolt 53 to limit the downward movement of nut 61. Since nut 61 is fixed to lower support 60 and funnel peripheral area 43, the axial displacement of nut 61 causes a corresponding displacement of funnel peripheral area 43. The use of sleeve 58 prevents the upward axial displacement of bolt 53 and sprocket wheel 57, thereby forcing nut 61 to axially displace.

As can be understood, the rotation of sprocket wheel 57, causing the corresponding axial displacement of funnel peripheral area 43, provides a means by which gap 36 of flow entrance area 31 can be adjusted and maintained.

Although the use of upper support 51 and lower support 60 provide additional lateral support to bolt 53, in an alternative arrangement (not shown), upper support 51 and lower support 60 may be eliminated, or formed integrally with spacer 52 and nut 61, respectively. In the spirit of the invention disclosed in FIG. 4, adjustment assembly 50 may be of any configuration such that the rotation of bolt 53 will cause the displacement of funnel 40. In such arrangements, a threaded nut may be utilized or threads provided in lower bolt opening 48 in funnel peripheral area 43. Likewise, any means for causing the rotation of bolt 53, such as by means of a sprocket, may be utilized.

In the preferred embodiment, gauge 14 is provided with suctioning apparatus 8. Gauge 14 comprises a rod 17 rigidly attached to funnel peripheral area 43 and extending slidingly upwardly through gauge opening 15 provided in upper member peripheral area 23 and cover 10 such that an upper portion of rod 17 is exposed above cover 10. Indicia 16 may be provided on rod 17 to correspond to the distance of gap 36, or to otherwise provide an indication of gap 36.

As best shown in FIGS. 2 and 3, and as previously discussed, the preferred embodiment utilizes four adjustment assemblies 50 to better maintain a uniform gap 36 between funnel peripheral area 43 and upper member peripheral area 23. A single chain 65 is preferably provided to provide rotation to sprocket wheel 57 of each adjustment assembly 50. As shown in FIG. 2, adjustable sprocket 84 may be provided as a means for regulating the tension in chain 65. As shown in FIG. 2, slot 83 may be provided in upper member plate 21 generally transverse to the movement of chain 65. An adjustable sprocket 84 may be attached within slot 83 by means of a nut and bolt fastener 85. As can be understood, the movement of adjustable sprocket 84 within slot 83 will either reduce or increase the tension force on chain 65 and thereby maintain chain 65 in driving engagement with each respective sprocket wheel 57. Chain 65 may comprise plastic, nylon or metal, and is configured to provide rotation to sprocket wheel 57.

Figure 5:
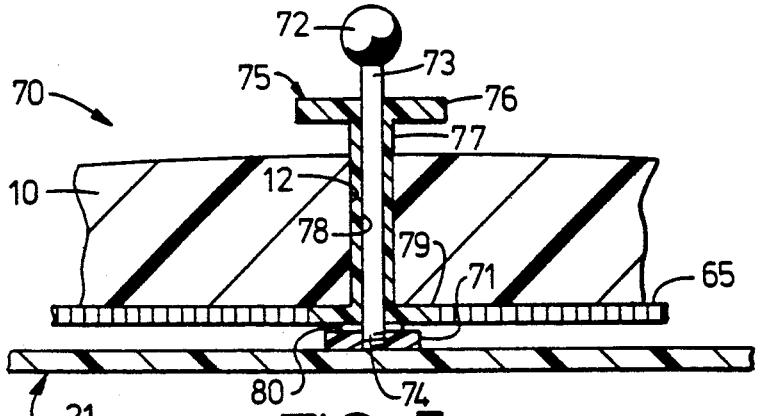
FIG. 5 is an enlarged partial cross-sectional fragmentary elevational view of the central portion of the control assembly shown in FIG. 3.

In the preferred embodiment shown in FIGS. 1-4, control assembly 70 is provided to move chain 65. Control assembly 70 is best shown in FIG. 5 comprising grip 75, knob shaft 73, and sprocket 79. In the preferred arrangement, knob shaft 73 is rigidly attached to upper member plate 21 by means of nut 71. Nut 71 is rigidly attached to the upper surface of upper member plate 21 by any secure means such as glue or welds. The proximal end of knob shaft 73 is provided with threads 74 for secure attachment to nut 71.

Grip 75 is disposed for rotation about knob shaft 73. Grip 75 comprises a handle portion 76, a grip shaft 77, and sprocket 79. Grip shaft 77 of grip 75 has an opening 78 throughout its length through which knob shaft 73 rotatably passes. Grip shaft 77 is disposed through and within cover 10 by means of opening 12 in cover 10.

Attached at the bottom portion of grip shaft 77 is sprocket 79 for engagement with chain 65. Sprocket 79 preferably rests on spacer 80 to allow rotation of sprocket 79 about knob shaft 73. Sprocket 79 is preferably circular in configuration, having teeth (not shown) for engagement with chain 65.

Handle portion 76 of grip 75 is attached to grip shaft 77 and located above cover 10. Handle portion 76 is preferably generally circular in shape and configured for secure grasp and rotation by hand.

In the preferred embodiment, knob 72 is provided at the upper portion of knob shaft 73. As shown in FIG. 5, knob shaft 72 is spherical and may be used as a securing point for attaching a rod or rope to suctioning apparatus 8 to secure suctioning apparatus 8 to other suction devices or to a vessel.

As can be understood, the rotation of handle portion 76 causes a rotation of grip shaft 77 and sprocket 79, thereby causing movement of chain 65. The movement of chain 65 will cause sprocket wheels 57 of adjustment assembly 50 to rotate. As previously discussed, the rotation of sprocket wheel 57 will cause the vertical movement of funnel 40, thereby increasing or decreasing gap 36 depending upon the direction of rotation of handle portion 76.

Figure 6:
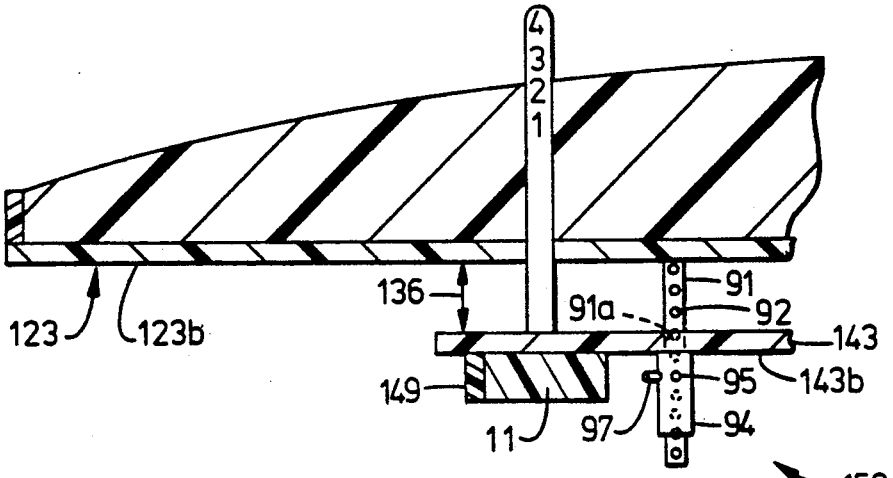
FIG. 6 is an enlarged partial elevational cross-sectional view of the left hand portion of an alternative embodiment of the adjustment assembly made in accordance with the subject invention.

FIG. 6 discloses an alternative embodiment of adjustment assembly 50, designated as adjustment assembly 150. In this embodiment, the proximal end of an upper shaft 91 is attached to lower surface 123*b* of upper member peripheral area 123 by any secure means such as glue or welds. Upper shaft 91 generally extends from upper member peripheral area 123 towards funnel peripheral area 143. Upper shaft 91 is preferably cylindrical, and has a plurality of holes 92 passing laterally therethrough.

A lower shaft 94 is attached to lower surface 143*b* of funnel peripheral area 143, and extends generally downwardly therefrom. Lower shaft 94 preferably has an hollow interior along its axis and throughout its length such that upper shaft 91 may pass telescopically therethrough. An opening 91*a* is provided in funnel peripheral area 143 above lower shaft 94 to allow upper shaft 91 to pass through lower shaft 94.

Lower shaft 94 includes at least one hole 95 passing laterally therethrough such that a cotter pin 97 may pass through hole 95 of lower shaft 94 and an aligned hole 92 of upper shaft 91. Other pins and fasteners known in the art may equally be utilized. As can be understood, the presence of a plurality of holes 92 in upper shaft 91 allows for the selective attachment of the upper shaft 91 and lower shaft 94. As such, pin 97 can be used to maintain a predetermined gap 136 between upper member peripheral area 123 and funnel peripheral area 143.

As needed, buoyancy material 11 may be attached to the lower surface of funnel peripheral 143. Buoyancy material 11 is shown in FIG. 6 adjacent funnel rib 149. Buoyancy material 11 may be utilized in the many different embodiments of the present invention to maintain suctioning apparatus 8 at the appropriate level with respect to the fluid to be suctioned. In particular, buoyancy material 11 may be utilized, as necessary, to position funnel peripheral area 143 at the oil-water interface (not shown in FIG. 6). It is believed that buoyancy material 11 may also contribute to the maintenance of upper member peripheral area 123 at the upper surface of the oil layer (not shown in FIG. 6). Buoyancy material 11 is preferably comprised of a material having a density less than water or oil, such as polystyrene.

In an alternative embodiment of the present invention (not shown), buoyancy material may be attached beneath the upper member peripheral area. However, it is preferred in such an arrangement that the buoyancy material be attached to the upper member peripheral area so as to not to significantly interfere with the flow of the oil layer into the flow entrance area.

In a further embodiment of the present invention (not shown), a porous membrane, such as a screen, may be attached to the perimeter of the lower surface of the upper member peripheral area. Such a screen may be utilized to prevent large articles or debris from entering suctioning apparatus 8.

As can be understood, and within the spirit and essence of the present invention, there can be constructed other various embodiments of suctioning apparatus 8. In one particular embodiment, suctioning apparatus 8 may be constructed such that a fixed gap is maintained between the upper member and the funnel (not shown). An example of such an arrangement would include a fixed rod connected to both the lower surface of the upper member peripheral area and the upper surface of funnel peripheral area.

In a further embodiment of the adjustment assembly of the present invention (not shown), a bolt may be rigidly attached to the funnel peripheral area. However, in this alternative embodiment, the upper bolt portion of the bolt would preferably be threaded for cooperating engagement with a threaded sprocket located above the upper member peripheral area. The threaded sprocket would be prevented from axial movement by means such as a cap or other device well known in the art. The bolt would be capable of axial displacement upwardly from the sprocket.

In operation, the rotation of the threaded sprocket of this alternative embodiment would axially displace the threaded bolt in engagement therewith, for reasons similar to that discussed with respect to the preferred embodiment. The axial displacement of the threaded bolt would cause the funnel attached to the bolt to move, thereby changing the relative gap between the funnel and the upper member.

Since this alternative embodiment utilizes a threaded bolt constructed for axial movement, sufficient space would be required above the bolt to accommodate such movement. In a further refinement of this alternative embodiment, the bolt could be combined integrally with a gauge whereby the axial displacement of the bolt/gauge would expose selective portions of the bolt/gauge extending upwardly above any cover provided with the suctioning apparatus.

Further embodiments of the present invention will become obvious to those skilled in the art. Although various adjustment assemblies may be utilized with the present invention, it is preferred that most of the components of the present invention be located beneath the upper surface of the fluid in which it is located (i.e., upper surface 37*a* of oil layer 37 in FIG. 4). It is believed that the displacement of fluid caused by the components of suctioning apparatus 8 located below upper surface 37*a* will decrease the effective weight of suctioning apparatus 8 within the fluid, thereby increasing the buoyancy of suctioning apparatus 8.

As is readily apparent, the suctioning apparatus of the present invention is preferably constructed to float at or near the surface of a fluid. In particular, suctioning apparatus 8 may be utilized to recover oil floating on top of a water surface. In operation, and as shown in FIG. 4, suctioning apparatus 8 is placed within the oil-water fluid such that upper member peripheral area 23 is maintained at or slightly below upper oil surface 37*a*. Funnel peripheral area 43 is preferably maintained at or slightly above the oil-water interface 39.

As best seen in FIG. 3, when a suction force is provided in the direction of arrow S at opening 47, the suction force will draw the oil near flow entrance area 31 into passageway 30 for recovery through suction hose 33*a*. In this manner, oil floating on top of a water surface can be quickly and efficiently recovered while limiting the unwanted collection of water.

The foregoing description of the preferred embodiments of the invention have been presented for purposes of illustration and description. It is not intended to be exhaustive or to limit the invention to the precise form disclosed. Obvious modifications or variations are Possible in light of the above teachings. The embodiments were chosen and described in order to best illustrate the principles of the invention and its practical applications, to thereby enable one of ordinary skill in the art to best utilize the invention and various embodiments and with various modifications as suited to the particular use contemplated. It is intended that the scope of the invention be defined by the claims appended hereto.

I claim:

1. An apparatus for suctioning fluid, said apparatus comprising:

(a) an upper member, said upper member comprising an upper member plate and a conical portion, said upper member plate further comprising a substantially planar upper member peripheral area extending beyond said conical portion;

(b) a funnel, said funnel comprising a conical portion and a funnel peripheral area; and (c) means for disposing said conical portion of said upper member at least partially within said conical portion of said funnel, thereby defining a passageway between said upper member and said funnel through which said fluid may be suctioned, wherein said upper member peripheral area extends outwardly and substantially beyond said funnel peripheral area a sufficient distance to provide means to reduce turbulence near the entrance of said passageway to allow for more efficient suctioning.

2. The apparatus of claim 1, wherein said conical portion of said upper member and said conical portion of said funnel comprise curved inwardly converging configuration.

3. The apparatus of claim 1 wherein an enclosed space is provided between said upper member plate and said conical portion of said upper member.

4. The apparatus of claim 1, further comprising an adjustment means for selectively adjusting said means for disposing said conical portion of said upper member at least partially within said conical portion of said funnel in order to adjust the width of said passageway defined by said funnel and said upper member.

5. The apparatus of claim 4 further comprising a plurality of adjustment means.

6. The apparatus of claim 5 further comprising a control assembly for simultaneously and selectively adjusting each said adjustment means.

7. The apparatus of claim 5 further comprising buoyancy material attached to said funnel.

8. An apparatus for suctioning fluid, said apparatus comprising:

(a) an upper member, said upper member comprising an upper member plate and a conical portion, wherein an enclosed space is formed between said upper member plate and said conical portion, and wherein said upper member plate further comprises a substantially planar upper member peripheral area extending beyond said conical portion;

(b) a funnel, said funnel comprising a conical portion and a funnel peripheral area;

(c) means for disposing said conical portion of said upper member at least partially within said conical portion of said funnel, wherein said funnel and said upper member define a passageway therebetween through which said fluid may be suctioned, and wherein said upper member peripheral area extends outwardly and substantially beyond said funnel peripheral area a sufficient distance to provide means to reduce turbulence near the entrance of said passageway to allow for more efficient suctioning.

9. The apparatus of claim 8 further comprising an adjustment means for selectively adjusting said means for disposing said conical portion of said upper member at least partially within said conical portion of said funnel in order to adjust the width of said passageway defined by said funnel and said upper member.

10. The apparatus of claim 9 wherein said adjustment means comprises:

(a) a nut attached to said funnel peripheral area;

(b) a bolt passing through said nut and through said funnel peripheral area and said upper member peripheral area, wherein a portion of said bolt is disposed above said upper member peripheral area;

(c) a rotatable sprocket attached to said portion of said bolt above said upper member peripheral area; and (d) a chain in contact with said sprocket for rotating said sprocket.

11. The apparatus of claim 10 further comprising a plurality of adjustment means and a control means for simultaneously and selectively adjusting each said adjustment means.

12. The apparatus of claim 11 wherein said control means comprises a sprocket in contact with said chain.

13. An apparatus for removing a floating liquid from the surface of a body of another liquid by mean of a suction device connected to said apparatus, said apparatus comprising:

(a) an upper member, said upper member comprising an upper member plate and a conical portion, wherein said upper plate further comprises an interior portion and a substantially planar upper member peripheral area extending beyond said conical portion;

(b) a funnel, said funnel comprising a conical portion and a funnel peripheral area; and (c) at least one adjustment assembly for adjustably disposing said conical portion of said upper member at least partially within said conical portion of said funnel, wherein said conical portion and said peripheral are a of said upper member and said conical portion and said peripheral area of said funnel define a passageway therebetween through which said floating liquid may be suctioned, and wherein said upper member and peripheral area extends outwardly and substantially beyond said funnel peripheral area a sufficient distance to provide means to reduce turbulence near the entrance of said passageway.

14. The apparatus of claim 13 wherein said adjustment assembly comprises:

(a) an upper shaft attached to said upper member plate, wherein said upper shaft generally extends towards said funnel;

(b) a lower shaft attached to said funnel, wherein said lower shaft generally extends away from said funnel and said upper member plate; and (c) means for attaching said upper shaft and said lower shaft.

15. The apparatus of claim 13 wherein said adjustment assembly comprises:

(a) a nut attached to said funnel peripheral area;

(b) a bolt passing through said nut and through said funnel peripheral area and said upper member peripheral area, wherein a portion of said bolt is disposed above said upper member peripheral area;

(c) a rotatable sprocket attached to said portion of said bolt above said upper member peripheral area; and (d) a chain in driving engagement with said sprocket.

16. An apparatus for suctioning fluid, said apparatus comprising:

(a) an upper member, said upper member comprising an upper member plate and a conical portion, wherein an enclosed space is formed between said upper member plate and said conical portion, and wherein said upper member plate further comprises an upper member peripheral area;

(b) a funnel, said funnel comprising a conical portion and a funnel peripheral area;

(c) means for disposing said conical portion of said upper member at least partially within said conical portion of said funnel, wherein said funnel and said upper member define a passageway therebetween through which said fluid may be suctioned; and (d) an adjustment means for selectively adjusting said means for disposing said conical portion of said upper member at least partially within said conical portion of said funnel in order to influence said passageway defined by said funnel and said upper member, wherein said adjustment means comprises a nut attached to said funnel peripheral area, a bolt passing through said nut and through said funnel peripheral area and said upper member peripheral area, wherein a portion of said bolt is disposed above said upper member peripheral area, a rotatable sprocket attached to said portion of said bolt above said upper member peripheral area, and a chain in driving contact with said sprocket for rotating said sprocket.

17. The apparatus of claim 16, further comprising a plurality of adjustment means and a control means for simultaneously and selectively adjusting each said adjustment means.

18. The apparatus of claim 17, wherein said control means comprises a sprocket in contact with said chain.

19. An apparatus for removing a first liquid from the surface of a body of another liquid by means of a suction device connected to said apparatus, said apparatus comprising:

(a) an upper member comprising an upper member plate and a conical portion, wherein said upper member plate further comprises an interior portion and an upper member peripheral area;

(b) a funnel comprising a conical portion and a funnel peripheral area; and (c) at least one adjustment assembly for adjustably disposing said conical portion of said upper member at least partially within said conical portion of said funnel, wherein said conical portion of said upper member and said conical portion of said funnel define a passageway therebetween through which said first liquid may be suctioned, and wherein said adjustment assembly comprises a nut attached to said funnel peripheral area, a bolt passing through said nut and through said funnel peripheral area and said upper member peripheral area, wherein a portion of said bolt is disposed above said upper member peripheral area, a rotatable sprocket attached to said portion of said bolt above said upper member peripheral area, and a chain in driving contact with said sprocket for rotating said sprocket.

* * * * *